US011845085B2

(12) United States Patent
Campos Orsi

(10) Patent No.: US 11,845,085 B2
(45) Date of Patent: Dec. 19, 2023

(54) FEED SYSTEM FOR GRINDING BODIES IN VERTICAL MILLS

(71) Applicant: METSO BRASIL INDÚSTRIA E COMÉRCIO LTDA., Sorocaba (BR)

(72) Inventor: Eduardo Campos Orsi, Sorocaba (BR)

(73) Assignee: METSO BRASIL INDÚSTRIA E COMÉRCIO LTDA., Sorocaba (BR)

( * ) Notice: Subject to any disclaimer, the term of this patent is extended or adjusted under 35 U.S.C. 154(b) by 495 days.

(21) Appl. No.: 17/054,391

(22) PCT Filed: May 10, 2019

(86) PCT No.: PCT/BR2019/050174

§ 371 (c)(1),
(2) Date: Nov. 10, 2020

(87) PCT Pub. No.: WO2019/213729

PCT Pub. Date: Nov. 14, 2019

(65) Prior Publication Data

US 2021/0094039 A1 Apr. 1, 2021

(30) Foreign Application Priority Data

May 11, 2018 (BR) ..... 10 2018 009587 0

(51) Int. Cl.
*B02C 17/00* (2006.01)
*B02C 17/20* (2006.01)
*B02C 21/00* (2006.01)

(52) U.S. Cl.
CPC ..... *B02C 17/205* (2013.01); *B02C 21/007* (2013.01)

(58) Field of Classification Search
CPC ..... B02C 17/183; B02C 17/205
See application file for complete search history.

(56) References Cited

U.S. PATENT DOCUMENTS 3,542,300 A * 11/1970 Arthur ..... B02C 17/205 222/162
4,394,980 A 7/1983 März et al.
(Continued)

FOREIGN PATENT DOCUMENTS

BR 2019050174 5/2019
CL 2020002923 A1 11/2020
(Continued)

OTHER PUBLICATIONS

International Search Report and Written Opinion for International Application No. PCT/BR2019/050174 dated Aug. 20, 2019.
(Continued)

*Primary Examiner* — Faye Francis
(74) *Attorney, Agent, or Firm* — ANDRUS INTELLECTUAL PROPERTY LAW, LLP

(57) ABSTRACT

A feed system for feeding grinding bodies to a vertical mill includes a pumping unit for sucking a propulsion liquid from a source and for supplying the liquid under pressure into a discharge tube. The system includes an intake connection having an inlet for grinding bodies, an inlet for propulsion liquid, connected to the discharge tube, and an outlet for grinding bodies and propulsion liquid. A principal tube is connected to the outlet of the intake connection for receiving the propulsion liquid and grinding bodies from the tubular intake connection. A static screen is arranged in the feed of the vertical mill for separating grinding bodies from propulsion liquid, the static screen having an inlet for propulsion liquid and grinding bodies, connected to the principal tube, an outlet for grinding bodies to be fed to the vertical mill, and an outlet for propulsion liquid separated from the grinding bodies.

19 Claims, 3 Drawing Sheets

(56) References Cited

U.S. PATENT DOCUMENTS

| | | | | |
|---|---|---|---|---|
| 4,643,365 | A * | 2/1987 | McKim | B02C 17/205 241/301 |
| 4,660,776 | A | 4/1987 | Ikebuchi et al. | |
| 4,715,546 | A * | 12/1987 | Holming | B02C 17/205 241/171 |
| 4,805,841 | A * | 2/1989 | Pausch | B02C 17/205 241/171 |
| 4,869,434 | A | 9/1989 | Folsberg | |
| 4,964,576 | A | 10/1990 | Datta | |
| 5,224,659 | A * | 7/1993 | Gabardi | B02C 17/205 241/34 |
| 5,624,080 | A | 4/1997 | Stehr et al. | |
| 7,567,855 | B2 * | 7/2009 | Salamanca | B02C 17/205 901/1 |
| 9,216,418 | B2 * | 12/2015 | Schaefer | B02C 17/161 |
| 9,333,507 | B2 * | 5/2016 | Foucher | B02C 17/205 |
| 2016/0144373 | A1 | 5/2016 | Haas et al. | |
| 2021/0094039 | A1 | 4/2021 | Orsi | |

FOREIGN PATENT DOCUMENTS

| | | | |
|---|---|---|---|
| DE | 3038794 | A1 | 5/1982 |
| DE | 3543190 | A1 | 6/1987 |
| EP | 0982074 | A1 | 3/2000 |
| WO | 2011072324 | A1 | 6/2011 |
| WO | 2012069042 | A2 | 5/2012 |
| WO | 2019213729 | A1 | 11/2019 |

OTHER PUBLICATIONS

Office action for corresponding Chinese Patent Application No. 2019800459969 dated Nov. 5, 2021.

Search report for corresponding Chinese Patent Application No. 2019800459969 dated Oct. 28, 2021.

Search report for corresponding Chilean Patent Application No. 202002923 dated Dec. 1, 2021.

Office action for corresponding Chilean Patent Application No. 202002923 dated Dec. 1, 2021.

Official Notification for corresponding Eurasian Application No. 202092710 dated Sep. 28, 2021.

* cited by examiner

FEED SYSTEM FOR GRINDING BODIES IN VERTICAL MILLS

CROSS-REFERENCE TO RELATED APPLICATIONS

This application is the U.S. national stage application of International Application PCT/BR2019/050174, filed May 10, 2019, which international application was published on Nov. 14, 2019, as International Publication WO 2019/213729 A1 in the English language. The International Application claims priority of Brazilian Patent Application No. 10 2018 009587 0 filed May 11, 2018.

FIELD OF THE INVENTION

The present invention relates to a system for providing the feed of grinding bodies, such as beads and other elements, into vertical mills used in the grinding of bulk material, generally ores.

BACKGROUND OF THE INVENTION

There are known bulk ore grinding plants that comprise arrays of vertical mills provided at the top with respective hoppers into which is periodically fed a replenishment charge of grinding bodies that may have the form of beads or balls of the actual mineral material to be ground.

One operational problem of these known grinding plants, which are provided with vertical mills generally around 10 or more metres in height, results from the solution normally adopted for feeding the hoppers of the vertical mills of the plant batchwise with the heavy replenishment charges of grinding bodies.

The daily consumption of grinding bodies in each mill of these known plants may be as much as around 1600 kg or even more, each mill being fed at intervals usually in excess of one day, owing to the number of mills of the plant usually being high, potentially as many as scores of mills, generally arranged in arrays in order to facilitate the feed thereof. Thus, each batchwise replenishment charge of grinding bodies may be as much as around 2000 kg, to be transported over the plant, at a height, until it is discharged into the hopper of a respective mill.

The equipment for mechanical lifting and transportation of these replenishment charges of grinding bodies, from the supply station to the upper hopper of each mill, are of generally complex construction and cumbersome owing to the safety requirements stipulated for transportation of heavy loads over industrial areas where there is a human presence.

In addition to the drawback in terms of construction mentioned above, the operation of transporting and feeding the replenishment charges of grinding bodies above the mills, using mechanical lifting equipment and overhead movement of these heavy charges in a batchwise fashion, is slow, taking up an undesirable amount of time to supply each mill and requiring the area over which the elevated charge is moved to be cleared on grounds of safety, thereby further compromising the operational efficiency of the plant.

One example of a vertical mill being fed at the top with replenishment charges of grinding bodies in a batchwise fashion may be seen in patent document U.S. Pat. No. 4,660,776.

SUMMARY OF THE INVENTION

Given the drawbacks of feed systems for replenishment charges of grinding bodies in vertical mills, using mechanical lifting and overhead transportation of said charges batchwise, it is an object of the present invention to provide a feed system for said replenishment charges that dispenses with the lifting and overhead transportation of grinding bodies batchwise over the industrial plant, allowing for selective feed of the charge of the mill, or each mill in the plant, to be performed progressively until the programmed quantity has been reached.

According to the invention, the feed system for grinding bodies in vertical mills comprises the features recited in claim 1.

The solution now proposed considerably simplifies the installation of the component elements of the feed system, completely dispensing with the lifting and transportation of heavy batchwise charges over the vertical mill plant and allowing progressive, remotely controlled feed of the charges of grinding bodies into the mill or each mill, respectively. Optional features of the feed system are recited in the dependent claims. In embodiments, the feed system comprises a pumping unit sucking a propulsion liquid from a source and pumping said liquid via a discharge tube; a tubular intake connection, in the form of a "T", for example, having an upper inlet for grinding bodies, a lower inlet for propulsion liquid and a lower outlet for propulsion liquid and grinding bodies; a principal tube connected to the lower outlet of the tubular intake connection and receiving the propulsion liquid and the grinding bodies fed into the tubular intake connection; and a static screen arranged above at least one vertical mill and having an inlet for propulsion liquid and grinding bodies connected to the principal tube, a median outlet for grinding bodies to be selectively and gravitationally fed to at least one vertical mill, and a lower outlet for propulsion liquid to be preferably returned to a collection site.

BRIEF DESCRIPTION OF THE DRAWINGS

Embodiments according to the present invention will be described below with reference to the appended drawings provided solely by way of example, and in which.

DESCRIPTION OF AN EMBODIMENT OF THE INVENTION

As already mentioned above, the feed system for grinding bodies according to the present invention is configured to be used in grinding plants comprising a plurality of vertical mills used in the grinding of bulk material, usually ores.

Figure 1:
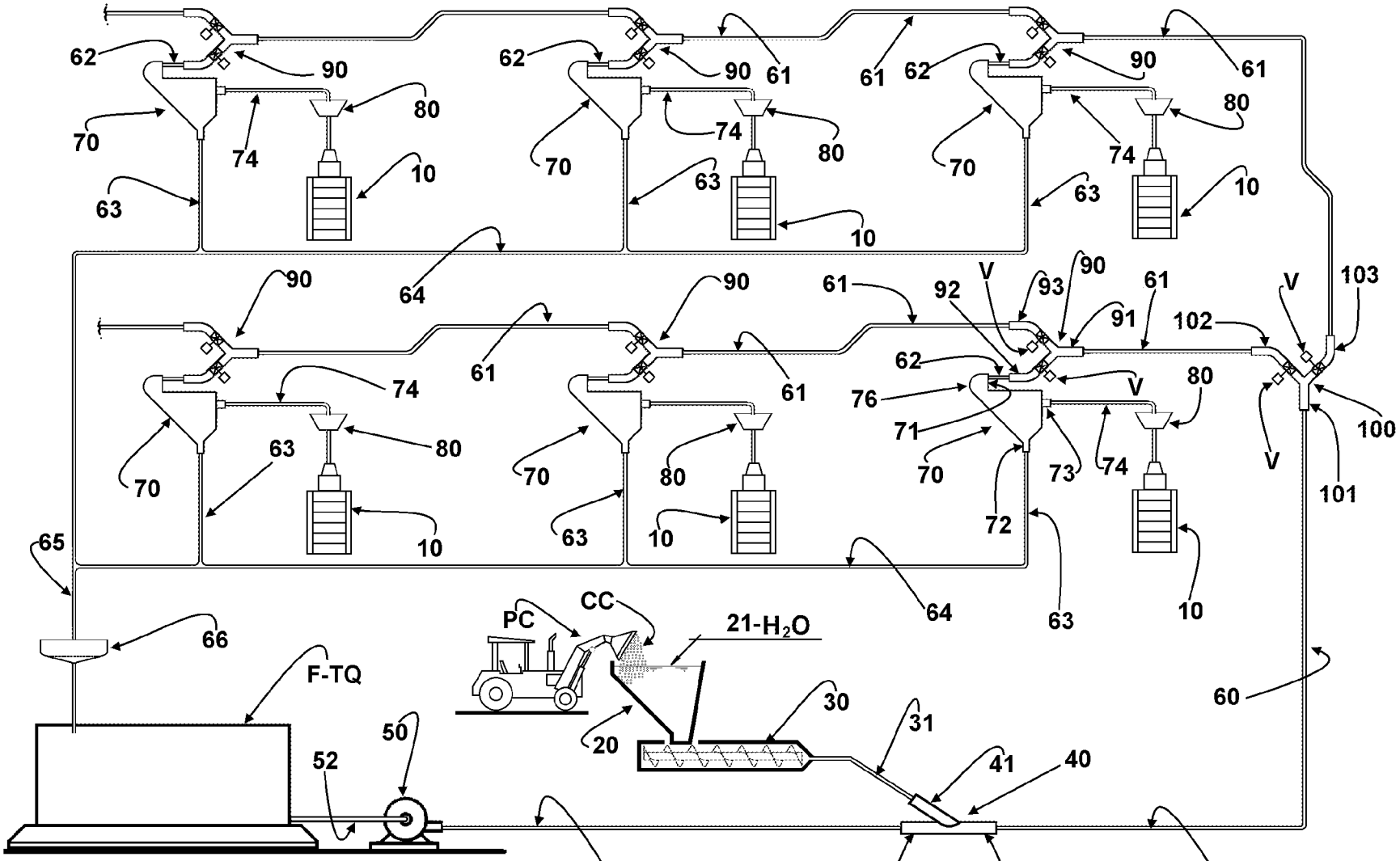
FIG. 1 shows an embodiment of the feed system of the present invention when used in a grinding plant that is by way of example provided with six vertical mills divided into two arrays of three subsequent mills.

FIG. 1 illustrates, schematically and by way of example, a plant comprising six vertical mills 10 arranged in two mutually parallel arrays of three subsequent mills 10. Each vertical mill 10 receives, at the top and generally by means of a conveyor worm (not shown), a feed of the bulk material to be ground and furthermore, generally, of an auxiliary water stream (not shown) for replenishing the water lost during the process. The corresponding elements of the vertical mills 10 are not illustrated or described here in greater detail; also, these elements may have different structures that are known in the art and do per se not form part of the present invention.

As illustrated in FIG. 1, grinding bodies CC, for example spheres or balls of the actual material to be ground, are discharged by any suitable transportation means, such as a loading shovel PC, into a feed hopper 20 generally arranged at ground level and receiving a charge of grinding bodies CC to be progressively released, from the bottom of the feed hopper 20, by means of a feed screw 30, the outlet of which is connected to a tubular intake connection 40 by a conduit 31 for gravitational conveyance of the grinding bodies CC.

The feed screw 30 is dimensioned and operated in order to produce a predetermined, controlled stream of grinding bodies CC into the interior of the conduit 31 that conveys to the tubular intake connection 40 provided in the discharge pipe 51 of a pumping unit 50 sucking a propulsion liquid, normally water, from a source F. The source F is generally defined by a tank TQ preferably arranged at ground level in the plant of vertical mills 10.

The feed hopper 20, feed screw 30, pumping unit 50, discharge pipe 51 and tubular intake connection 40 form part of a feed system according to an embodiment of the invention. The tubular intake connection 40 may be constructed in different ways provided it is capable of receiving, under gravity, the feed of grinding bodies CC originating from the feed hopper 20, releasing said bodies into the propulsion stream received from the discharge tube 51, allowing the grinding bodies CC to be conveyed by the propulsion stream until they reach the static screen(s) 70 of the vertical mill(s) 10, the target of the feed of grinding bodies CC in the feed system according to the embodiment.

In the configuration illustrated, the tubular intake connection 40 has approximately the form of a "T" connection, having an upper feed inlet 41 for grinding bodies CC, a lower inlet 42 for propulsion liquid, connected to the discharge tube 51, and a lower outlet 43 for grinding bodies CC and propulsion liquid.

It must be understood that the tubular intake connection may have variations in form provided the form allows the stream of grinding bodies CC, originating from the feed hopper 20, to be fed to the stream of propulsion liquid passing through the inside of the tubular intake connection 40.

It is not compulsory for the tubular intake connection to have the form of an orthogonal "T", and it may have an angle as illustrated or any different angle between the axis of the upper inlet 41 and the axis of the discharge tube 51 and further localized variation in the internal cross-sectional dimensions in the tubular intake connection 40.

The discharge pipe 51 may be formed from any suitable material, such as steel, since only the propulsion liquid flows through said pipe.

The feed hopper 20 further receives a stream of feed liquid 21, generally water, that is conveyed by the feed screw 30 in conjunction with the grinding bodies CC to the tubular intake connection 40.

The pumping unit 50, formed by one or more centrifugal pumps in series, sucks the propulsion liquid from the source F, generally a tank TQ, via a suction pipe 52 connected to the tank TQ and formed from any suitable material, such as steel or rubber-coated steel, pumping said liquid via the discharge pipe 51 and through the tubular intake connection 40, charging the grinding bodies CC into the interior of a principal tube 60 of the feed system according to the embodiment, the principal tube 60 being preferably formed from steel internally coated with rubber, but potentially having flexible portions formed only from rubber. The principal tube 60 is connected to the lower outlet 43 of the tubular intake connection 40 to receive the propulsion liquid and the grinding bodies CC released by the lower outlet 43 of the tubular intake connection 40.

The dimensions of the pumping unit 50, the tubular intake connection 40 and the principal tube 60 of the feed system are such as to guarantee a speed of transportation for the propulsion liquid that is greater than the rate at which the grinding bodies CC settle.

By way of example, in a situation in which the grinding bodies CC are defined by balls of cast steel, with a diameter of around 19 mm, the speed of transportation desired, ranging from 4 to 7 m/s, may be achieved with a concentration of around 6% by weight of grinding bodies in the stream of propulsion liquid, the flow rate of which is determined, furthermore, as a function of the desired rate of feed of the charge of grinding bodies CC to each of the vertical mills 10 of the plant, and may, for example, be almost 320 $m^3/h$ of the propulsion liquid.

The principal tube 60 extends from the tubular intake connection 40 to the upper region of a single vertical mill 10 (not shown) or of at least one array of vertical mills 10.

In the case of a single vertical mill 10, this being conceptually possible situation, the principal tube 60 may be directed directly to the static screen 70 of the vertical mill 10. The static screen 70 is arranged above the feed of the vertical mill 10 and provided with an inlet 71 for the propulsion liquid carrying the grinding bodies CC, a lower outlet 72 for propulsion liquid and a median outlet 73 for grinding bodies CC to be selectively and gravitationally fed to a vertical mill 10.

FIG. 1 of the appended drawing shows, by way of example, for reasons of graphic space limitation, an installation comprising only two arrays of vertical mills 10, each array comprising three vertical mills 10 in series. It should, however, be understood that not only the number of arrays but also the number of vertical mills per array may vary in accordance with each industrial plant without departing from the concept proposed herein.

In situations where the present invention is particularly advantageous, the principal tube 60 is divided into branch tubes 61 each arranged to work with a single vertical mill 10 or a plurality of vertical mills 10 arranged in a respective array of mills, which is the case illustrated in FIG. 1.

In the construction illustrated, the grinding bodies CC, released via the median outlet 73 of the static screen 70, are conveyed, via a conduit 74, to an inlet hopper 80 arranged above the feed of the vertical mill 10, and open at the bottom facing the interior of said mill, in order gravitationally to feed said mill with the grinding bodies CC gravitationally received from the median outlet 73 of the static screen 70.

Figure 4:
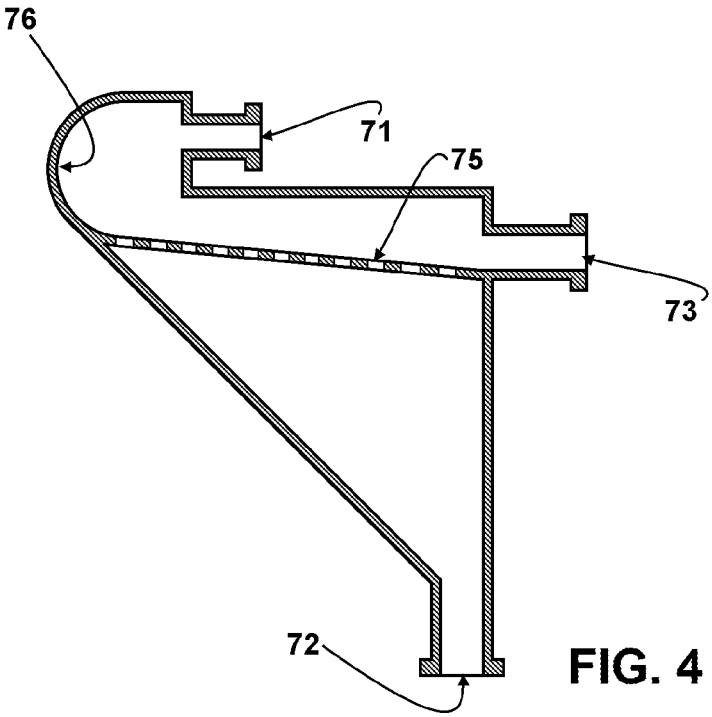
FIG. 4 shows a view in longitudinal section of the static screen illustrated in FIG. 3.

As illustrated in FIG. 4, the static screen 70 is provided, below its inlet 71, with a mesh assembly 75, made from steel or polyurethane, covering the entire transverse area of the static screen 70, slightly inclined towards the median outlet 73 for grinding bodies CC. Beneath the mesh assembly 75, made from steel or polyurethane, the static screen 70 has a bottom inclined towards the lower outlet 72, for the release of the propulsion liquid to a respective return collector 63 and from the latter to a branch collector 64 and then to a common collector 65, these collectors being further described below.

The static screen 70 further comprises a deflector wall 76, arranged in front of the inlet 71, for receiving the propulsion stream with the grinding bodies CC, redirecting, on a curved trajectory, said propulsion stream in a direction opposite to that of the inlet and over the mesh assembly 75, made from steel or polyurethane, towards the median outlet 73. The static screen 70 may be coated internally with rubber in order to prolong its working life.

Each vertical mill 10 of an array has its hopper 80 fed selectively with grinding bodies CC from the median outlet 73 of a respective static screen 70 and via a respective inlet tube 62 that is connected, on one side, to the inlet 71 of the static screen 70 and, on the other side, to one of the lateral outlet branches 92 of a "Y"-connection 90 having a central inlet branch 91 defining the inlet for the propulsion liquid with grinding bodies CC originating from the principal tube 60, whilst the other lateral outlet branch 93 of the connection 90 defines the outlet for the propulsion liquid with the grinding bodies CC for selective feeding of one or more other, subsequent vertical mills 10 in said array of mills.

Each lateral branch 92, 93 of the connection 90 receives a stream-blocking valve V. The stream-blocking valves V may be of the pinch-valve type, with a construction that is sufficiently robust to withstand, when closed, the forces resulting from the interruption of the stream through the tube on which they are installed, in order to force the stream of propulsion liquid with the grinding bodies CC to follow the trajectory through the other branch of the "Y"-branching.

The inlet tubes 62 of the vertical mills 10 of one and the same array are each connected to a respective lateral outlet branch 92 of a connection 90 having the central inlet branch 91 and the other lateral outlet branch 93 connected in series to a branch tube 61, said branch tube 61 having one end connected to a lateral outlet branch 102, 103 of a principal coupling piece 100, the central inlet branch 101 of which is connected to the principal tube 60.

The propulsion liquid, which is released via the lower outlet 72 of each static screen 70 during operation, returns under gravity to the source F, which may be the tank TQ of propulsion liquid, by means of the return collector 65.

When arrays of vertical mills 10 are provided, an individual collector 63 is furthermore provided, connecting the lower outlet 72 of each static screen 70 of an array of vertical mills 10 to a branch collector 64 that is connected to the return collector 65. In this case, the propulsion liquid operates in closed circuit, a return screen 66 arranged in the return collector 65, upstream of the tank TQ, generally being provided.

Where the vertical mills 10 are not arranged in arrays, the individual collector 63 of each vertical mill 10 may be connected directly to the return collector 65. In the case of a single mill, the individual collector 63 acts as the actual return collector 65. The individual—branch and return—collectors are preferably in the form of tubular collectors.

Considering that, in the situation illustrated in FIG. 1, the stream of propulsion liquid carries the solid grinding bodies CC through the principal tube 60, the branch tubes 61 and the inlet tubes 62, the branchings necessary for selective conveyance of the grinding bodies CC to each vertical mill 10 to be charged have to be made in such a manner as to reduce the impacts of the solid bodies against the internal deflector walls of the principal tube 60, the branch tubes 61 and the inlet tubes 62.

Figure 2:
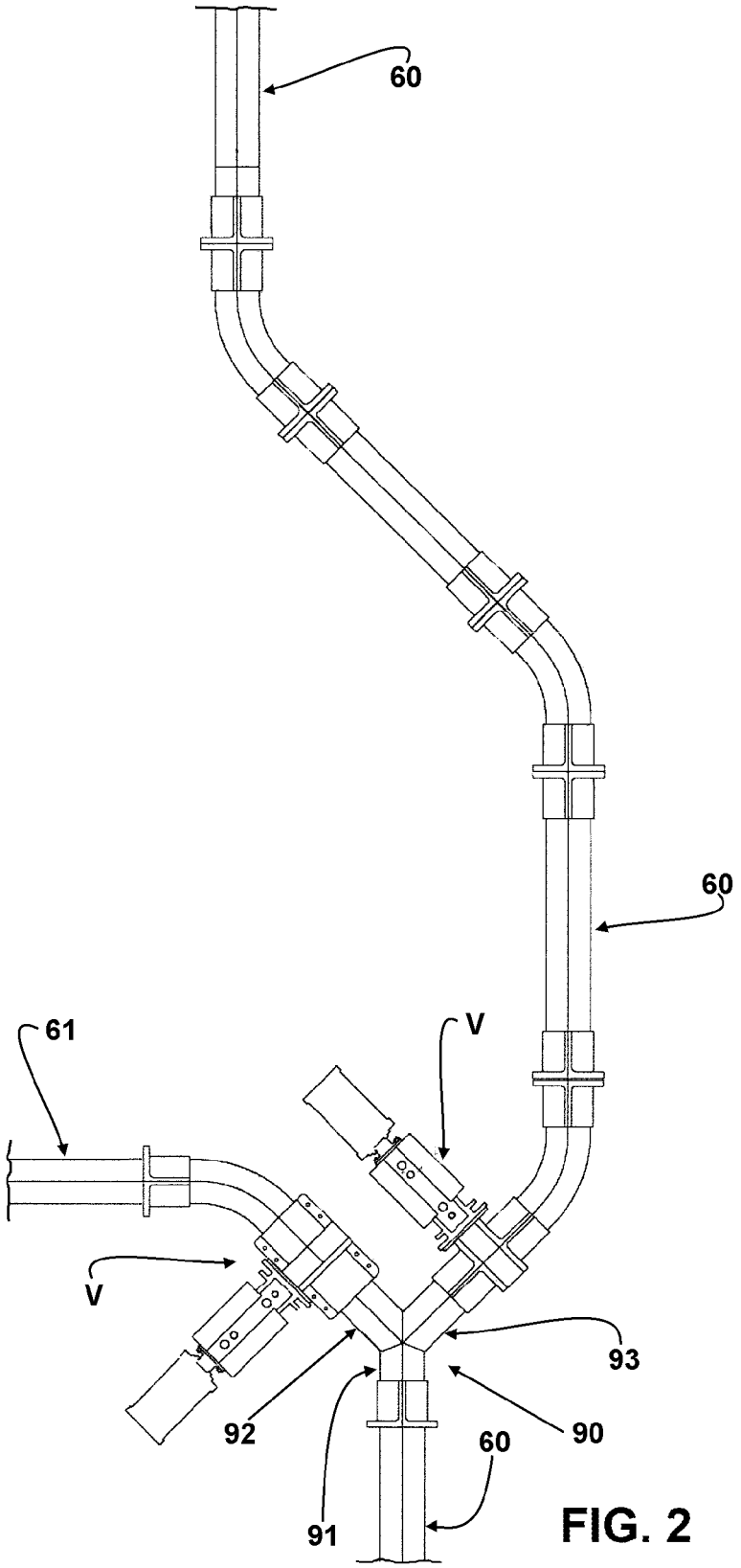
FIG. 2 is an enlarged detailed illustration of "Y"-branchings provided in embodiments of the feed system of the present invention, from the principal tube to a branch for each mill array and also from the branch of an array to each respective mill, illustrating the guided conveyance of the stream of grinding bodies and also the positioning of the stream-guiding valves, with remote control, in each branching.
Figure 3:
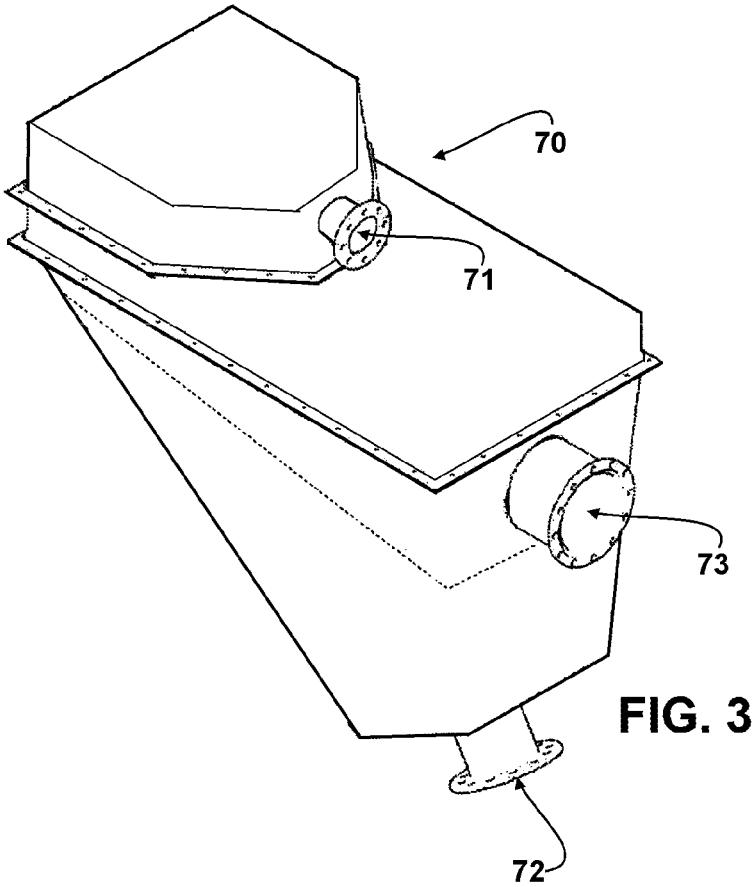
FIG. 3 is a perspective view of a static screen provided in embodiments of the feed system of the present invention in the feed of the or each mill, for separating the grinding bodies from the stream of propulsion liquid.

Thus, as illustrated in FIGS. 1 and 2, the branchings (i.e. the principal coupling piece 100 and the connections 90 downstream therefrom) may be made in the form of a "Y", with the central branch receiving the inlet stream. The lateral outlet branches may each receive a stream-blocking valve V, which is remotely controlled. By way of example, in the configuration illustrated, the stream-blocking valves V are actuated pneumatically, it having to be understood that this actuation may be provided in different ways, with control from a remote central control unit (not shown).

Despite only one arrangement for the feed system of the invention having been illustrated, it must be understood that the feed system may be used in different arrangements of vertical mills 10, with different distribution arrangements for the principal 60 tube, branch tubes 61 and inlet tubes 62.

The invention claimed is:

1. A feed system configured to feed grinding bodies to a plurality of vertical mills, the feed system comprising:

a pumping unit operable to suck a propulsion liquid from a source and for supplying said liquid under pressure into a discharge tube, an intake connection having an inlet configured to receive grinding bodies, an inlet configured to receive the propulsion liquid which is configured for connection to the discharge tube, and an outlet for a mixture of the grinding bodies and the propulsion liquid, a principal tube connected to the outlet of the intake connection for receiving the mixture of the propulsion liquid and the grinding bodies from the intake connection, a plurality of inlet tubes each branched off of the principal tube and configured to direct the mixture of the propulsion liquid and the grinding bodies from the principal tube to one of the plurality of vertical mills, and a plurality of static screens each positionable in the feed to one of the plurality of the vertical mills for separating the grinding bodies from the propulsion liquid, the static screen having an inlet connected to one of the plurality of inlet tubes for receiving the mixture of the propulsion liquid and the grinding bodies, a grinding bodies outlet configured to receive the grinding bodies to be fed to the respective vertical mills, and a propulsion liquids outlet configured to receive the propulsion liquid separated from the grinding bodies.

2. The feed system of claim 1, further comprising a plurality of inlet hoppers each configured to be positioned above the feed of one of the plurality of the vertical mills for feeding said respective vertical mills with the grinding bodies received from the grinding bodies outlet of the static screen.

3. The feed system of claim 2, further comprising a conduit, connected to the grinding bodies outlet of the static screen, for conveying the grinding bodies released by said grinding bodies outlet to the inlet hopper.

4. The feed system of claim 1, in which the inlet tubes to the respective static screens are connected to a respective first outlet branch of a respective coupling piece, each coupling piece having an inlet branch defining an inlet configured to receive the mixture of the propulsion liquid with grinding bodies originating from the principal tube, the coupling piece further including a second outlet branch that defines an outlet for propulsion liquid and grinding bodies for feeding one of the plurality of vertical mills.

5. The feed system of claim 4, wherein each of the outlet branches of the coupling pieces and/or the outlet branches of the principal branching piece is provided with a stream-blocking valve.

6. The feed system of claim 4, wherein in at least some of the coupling pieces and/or the principal branching piece, the inlet branch and first and second outlet branches are arranged in a "Y"-shape, with the inlet branch forming a central branch of the "Y"-shape and the first and second outlet branches forming lateral branches of the "Y"-shape.

7. The feed system of claim 1, in which the inlet branches and the second outlet branches of the coupling pieces are connected in series by a branch tube.

8. The feed system of claim 7, wherein said branch tube in turn has one end connected to an outlet branch of a principal branching piece, and an inlet branch of the principal branching piece is connected to the principal tube.

9. The feed system of claim 1, further comprising a principal branching piece having an inlet branch connected to the principal tube and two or more outlet branches connected to respective branch tubes for supplying the propulsion liquid and grinding bodies towards respective vertical mills or towards respective arrays of subsequent vertical mills.

10. The feed system of claim 1, wherein the pumping unit comprises a suction pipe configured for connection to the source of propulsion liquid.

11. The feed system of claim 1, further comprising a return collector connected to the propulsion liquid outlet of each static screen for returning the propulsion liquid released by the propulsion liquid outlet to the source of the propulsion liquid.

12. The feed system of claim 11, further comprising an individual collector connecting the propulsion liquid outlet of each static screen to a branch collector connected to the return collector.

13. The feed system of claim 11, further comprising a return screen arranged in the return collector and positioned upstream of the tank.

14. The feed system of claim 11, in which each static screen comprises downstream of its inlet a mesh assembly slightly inclined towards the outlet for the grinding bodies.

15. The feed system of claim 14, in which each static screen comprises a bottom inclined towards the propulsion liquid outlet for the release of the propulsion liquid to the return collector.

16. The feed system of claim 14, in which each static screen further comprises a deflector wall, arranged in front of the inlet, for receiving the propulsion liquid with the grinding bodies and for redirecting said propulsion liquid over the mesh assembly towards the first outlet for the grinding bodies.

17. The feed system of claim 16, in which the deflector wall is arranged for redirecting said propulsion liquid on a curved trajectory in a direction opposite to that of the inlet and over the mesh assembly towards the grinding bodies outlet.

18. The feed system of claim 11 wherein the propulsion liquid released by the propulsion liquid outlet is returned to the source of propulsion liquid by gravity.

19. The feed system of claim 1, further comprising a feed hopper positioned for receiving a charge of grinding bodies and a feed screw for progressively releasing grinding bodies from the bottom of the feed hopper, an outlet of the feed screw being connected to the inlet of the intake connection.

* * * * *